United States Patent [19]

Combs et al.

[11] Patent Number: 4,576,017

[45] Date of Patent: Mar. 18, 1986

[54] INSULATED SHIPPING CONTAINER

[75] Inventors: Cathy M. Combs, Antioch; Joseph K. Duffy, Lake Forest; Mark Thoene, Ingleside, all of Ill.

[73] Assignee: Baxter Travenol Laboratories, Inc., Deerfield, Ill.

[21] Appl. No.: 705,584

[22] Filed: Feb. 26, 1985

[51] Int. Cl.[4] ..... F25D 3/08

[52] U.S. Cl. ..... 62/372; 62/388; 62/457

[58] Field of Search ..... 62/384, 388, 459, 463, 62/372, 457

[56] References Cited

U.S. PATENT DOCUMENTS

| | | | |
|---|---|---|---|
| 2,400,742 | 5/1946 | Clerc | 62/388 |
| 3,866,435 | 2/1975 | Frank et al. | 62/388 X |
| 3,889,486 | 6/1975 | Hinckley et al. | 62/388 X |
| 4,294,079 | 10/1981 | Benson | 62/388 |
| 4,457,142 | 7/1984 | Bucher | 62/388 |

*Primary Examiner*—Lloyd L. King

*Attorney, Agent, or Firm*—Paul C. Flattery; John P. Kirby, Jr.

[57] ABSTRACT

A container is disclosed for maintaining its contents at a desired temperature for an extended period of time such as for use in shipping contents in a frozen condition. The container includes an outer shell which is substantially airtight and which has an inner surface; a passive heat exchange medium; a support structure for the heat exchange medium; and means for maintaining an air space between the contents of the container and substantially the entire inner surface of the outer shell of the container and between the contents of the container and the support structure for the heat exchange medium for allowing convection current to develop in the air space which circulates past the heat exchange medium and maintains a substantially uniform temperature around the contents of the container.

11 Claims, 8 Drawing Figures

INSULATED SHIPPING CONTAINER

The present invention relates to a container for maintaining the contents of the container at a desired temperature for an extended period of time. In addition, the invention relates to a container for maintaining the contents at a substantially uniform temperature throughout the container. For example, the present invention is directed to a shipping container for maintaining all of the contents of the container in a frozen or cold condition or in a warm or hot condition for a period of up to ninety hours in order to enable the contents to be shipped by air and arrive at the destination in the desired frozen, cold, warm or hot condition.

The container comprises: an outer shell which is substantially airtight and which has an inner surface; a passive heat exchange medium; a support structure for the heat exchange medium; and means for maintaining space between the contents of the container and substantially the entire inner surface of the sides and bottom of the outer shell of the container and between the contents of the container and the support structure for the heat exchange medium. The space allows convection in the space. The convection maintains a substantially uniform temperature throughout the contents of the container.

Previously used containers do not provide a means for maintaining space around the contents of the container. Nor do the previously used containers provide any other means for allowing convection within the container. As a result previously used containers suffer from the disadvantage that a uniform temperature is not maintained throughout the contents of the container. For example, in a previously used container for maintaining contents in a cold or frozen condition, dry ice is sometimes used in the container. The dry ice is located in one section of the container. The contents of the container which are closest to the dry ice are maintained at a lower temperature than the contents of the container which are furthest away from the dry ice. For containers intended for use in shipment in airplanes, there usually are restrictions on the amount of dry ice which can be used because dry ice releases carbon dioxide as it melts.

In previously used containers, the contents of the container are allowed to rest on the bottom inner surface of the container. As a result, there is no air space between the contents and the bottom of the inner surface of the container. As a result, convection cannot develop around or past the bottom portion of the contents and the bottom inner surface of the container. In other containers, the contents are allowed to fill up substantially the entire space within the container, with no air space between the contents and the sides of the container. As a result, convection cannot develop between the contents and the sides of the container. Thus, previously used containers do not maximize the efficiency which can be obtained when using dry ice, measured in terms of the length of time for which a given quantity of dry ice is capable of maintaining the contents of the container in a frozen or cold condition.

It is an object of the present invention to provide a shipping container for maintaining the contents of the container in a frozen condition or in a cold condition or in a warm condition or in a hot condition for a period of up to ninety hours in order to enable the contents to be shipped by air and arrive at its destination in the desired frozen cold, warm or hot condition.

It is another object of the present invention to provide a container which more efficiently uses dry ice, ordinary ice or a warm or hot material to keep the contents of the container at a desired temperature.

It is another object of the invention to provide a container which allows convection within the container in space around the contents to allow convection to maintain a substantially uniform temperature throughout the contents of the container.

DESCRIPTION OF PREFERRED EMBODIMENT

EXAMPLE NO. 1

An example of a preferred embodiment of the present invention, adapted for use for the shipment of frozen products in an airplane, is illustrated in FIGS. 1–4. The outer dimensions of the insulated shipping container, indicated generally by the numeral 2, are adapted to conform to the size requirements of commercial aircraft. In its assembled condition for the shipment of frozen products, the container 2 is 55 inches high, 50½ inches wide, and 55⅞ inches long. Slats 4 of wood or other material are fastened to the bottom outer surface of the container 2 in order to enable the container 2 to be handled by a forklift.

Figure 3:
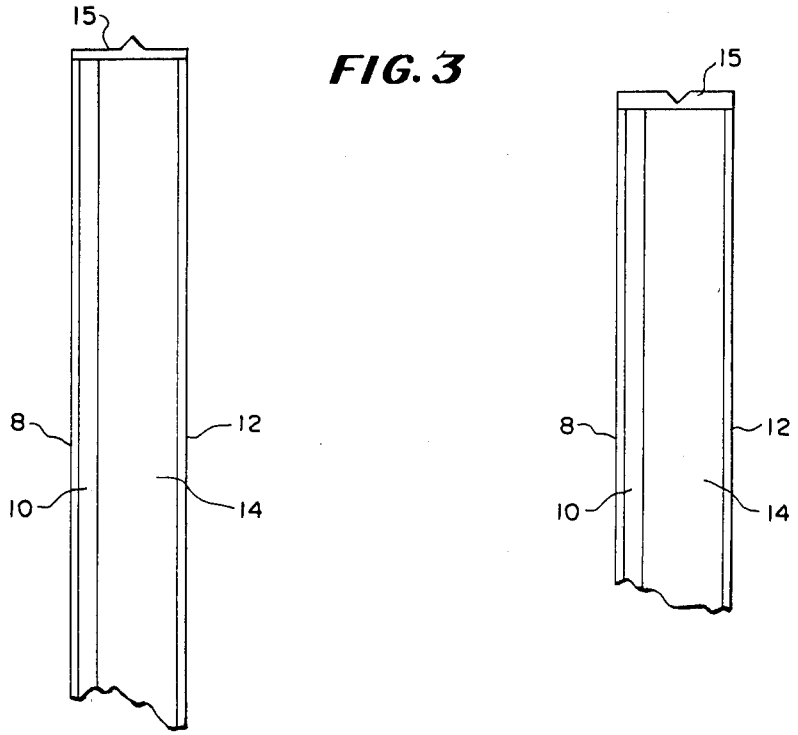
FIG. 3 is a cross sectional view of the outer shell of the container shown in FIGS. 1 and 2.

Referring to FIG. 3, the outer shell 6 of the container 2 comprises an impact resistant outer layer 8; a rigid high-strength layer 10 next to the outer layer 8; an inner layer 12; and an insulating layer 14 between the rigid, high-strength layer 10 and the inner layer 12. The impact resistant outer layer 8 is made of a plastic material, is about one-eighth inch thick and has a silver or white coating on its outer surface to reflect heat. The rigid, high-strength layer 10 next to the outer layer 8 is made of three-quarter inch plywood of high quality, such as marine grade plywood. The inner layer 12 is made of a plastic material, is one-eighth inch thick, and the inner surface of the inner layer is painted black to absorb heat. The insulating layer 14 is made of a insulating material such as a foam plastic and is two to four inches thick.

Figure 1:
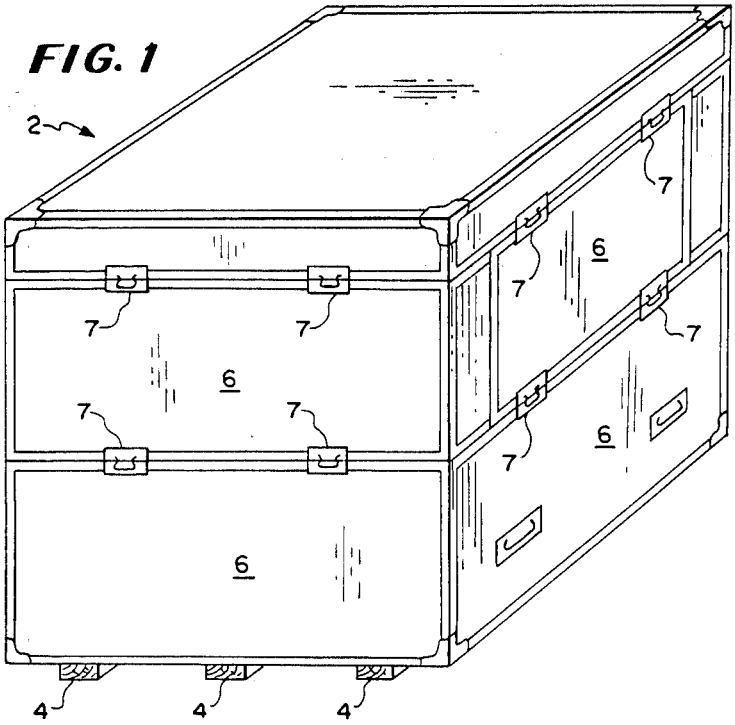
FIG. 1 is an isometric view of a first preferred embodiment of an insulated shipping container.
Figure 2:
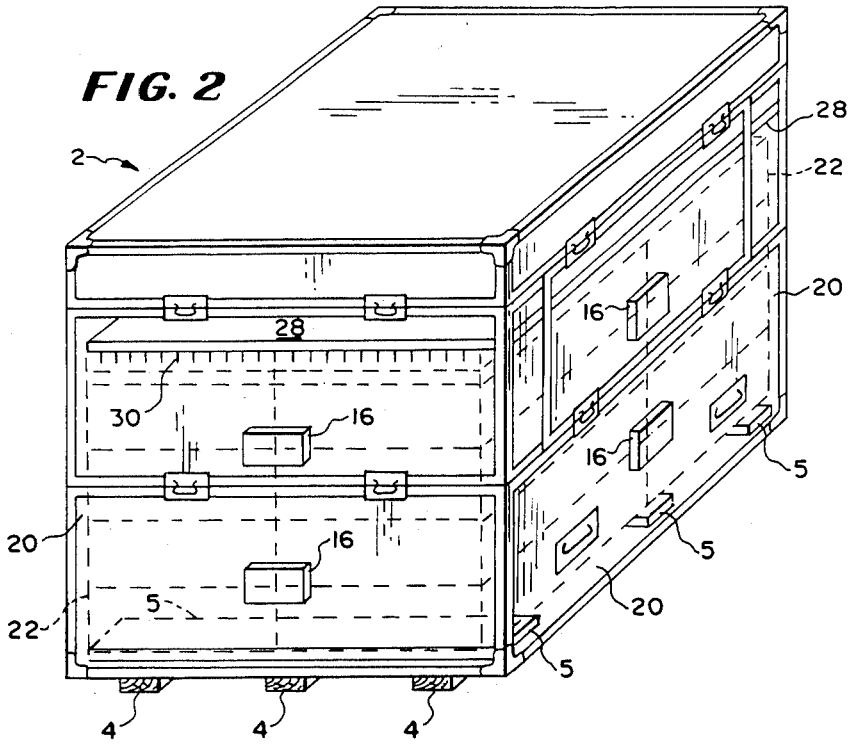
FIG. 2 is another isometric view of the container of FIG. 1, showing interior components of the container.
Figure 4:
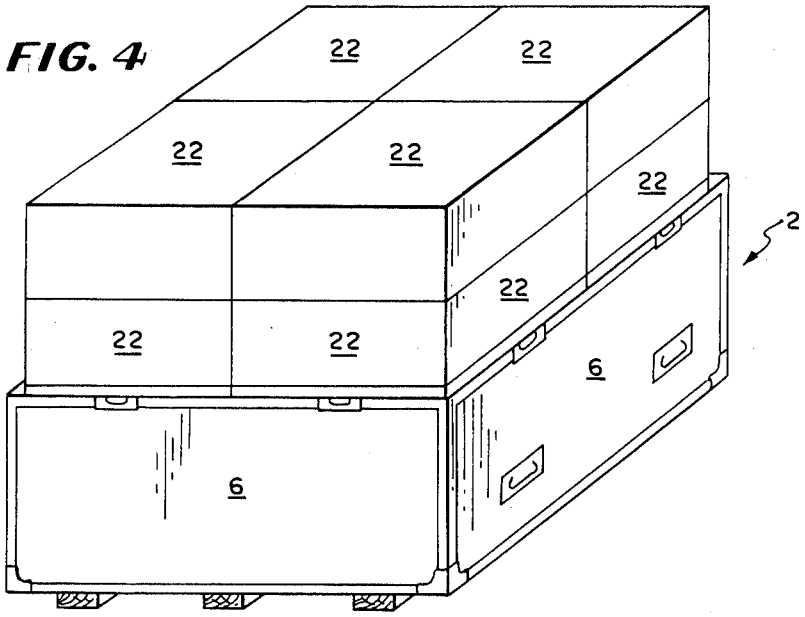
FIG. 4 is an isometric view of the containers of FIGS. 1 and 2, with sections of the outer shell removed.

Referring to FIGS. 1, 2 and 4, the sides of the outer shell 6 of the container 2 are made in sections. The sections can be assembled together when the container 2 is used for shipping product. The container 2 can be disassembled when not in use for the shipment of product. Some of the sections of the outer shell 6 can be stored inside of other sections of the outer shell 6. The container 2 in its disassembled condition occupies a smaller volume, such as, about half the volume in its assembled condition. Compression locks 7 and gaskets are used to achieve a substantially airtight condition when the container 2 is assembled. Referring to FIG. 3, the sections of the outer shell 6 have sealing means in the form of a tongue and groove aluminum molding 15 on the edges to achieve an air tight fit.

Referring to FIGS. 1 and 2, in its assembled condition the container 2 has blocks 16 arranged on the inner surface of the outer shell 6 which maintain a space 20 between the inner surface of the outer shell 6 and the contents 22. In this embodiment, the contents are in the form of corrugated cardboard cartons. Referring to FIG. 2, a total of eight spacer blocks 16 are used. The spacer blocks 16 are positioned so that each spacer block 16 touches the corner of four cardboard cartons. Additional spacer blocks 16 may be used in other locations on the inner surface of the outer shell 6. A wide variety of spacing devices may be used to maintain the space 20. The container 2 also includes plastic slats 5 on the bottom inner surface of the shell 6. The contents 22 rest on the slats 5 and the slats 5 maintain a space of about one inch or more between the bottom surface of the contents 22 and the inner surface of the shell 6. Preferably, the space 20 maintained is about one inch or slightly more around the contents 22 . Such a space 20 is maintained around all sides between the contents 22 and the inner surface of the shell 6, between the bottom of the contents 22 and the inner surface of the bottom of the outer shell 6 and between the top surface of the contents 22 and the support structure 28 for the heat exchange medium.

Figure 5:
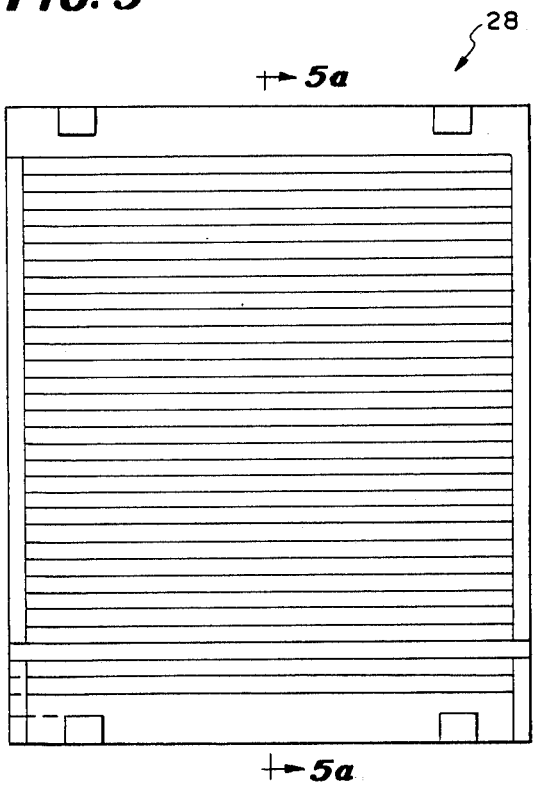
FIG. 5 is a top view of a component of the container of FIGS. 1–4.
Figure 5A:
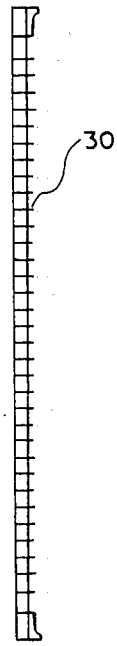
FIG. 5*a* is a cross-sectional view of FIG. 5 along the line 5*a*—5*a*.

Referring to FIGS. 2 and 5, the support structure 28 for the heat exchange medium is a tray arranged near the top of the outer shell 6. The support structure 28 has a solid surface adjacent to the outer shell 6 and an arrangement of fins 30 on the bottom surface of the support structure 28. Preferably, the passive heat exchange medium is dry ice. The dry ice is placed on the top side of the support structure 28. The fins 30 maximize the surface area available to convection which developes in space 20 around the contents 22 and passes between the contents 22 and the support structure 28. Heat from convection is conducted by the fins 30 through the top surface of the support structure 28 and is absorbed by the dry ice. The term "passive", used to describe the heat exchange medium, refers to the fact that there is no mechanical or electrical mechanism associated with the heat exchange medium.

The fins 30 also act as a spacing device. The lower edge of the fins 30 rests on the top of the contents 22 and position the support structure about an inch, an inch and one-half or slightly more above the contents 22. A space is provided between the top surface of the support structure 28 and the top of the outer shell 6 sufficient to accommodate the dry ice or other passive heat exchange medium. The brackets also position the support structure 28 in a position to allow one inch or slightly more of space between the fins 30 and the top of the contents 22.

The present invention may be used for shipment of products on transportation other than air or for use in the storage of products, even where no shipment is contemplated. Other dimensions for the outer shell 6 may be used.

EXAMPLE NO. 2

Figure 6:
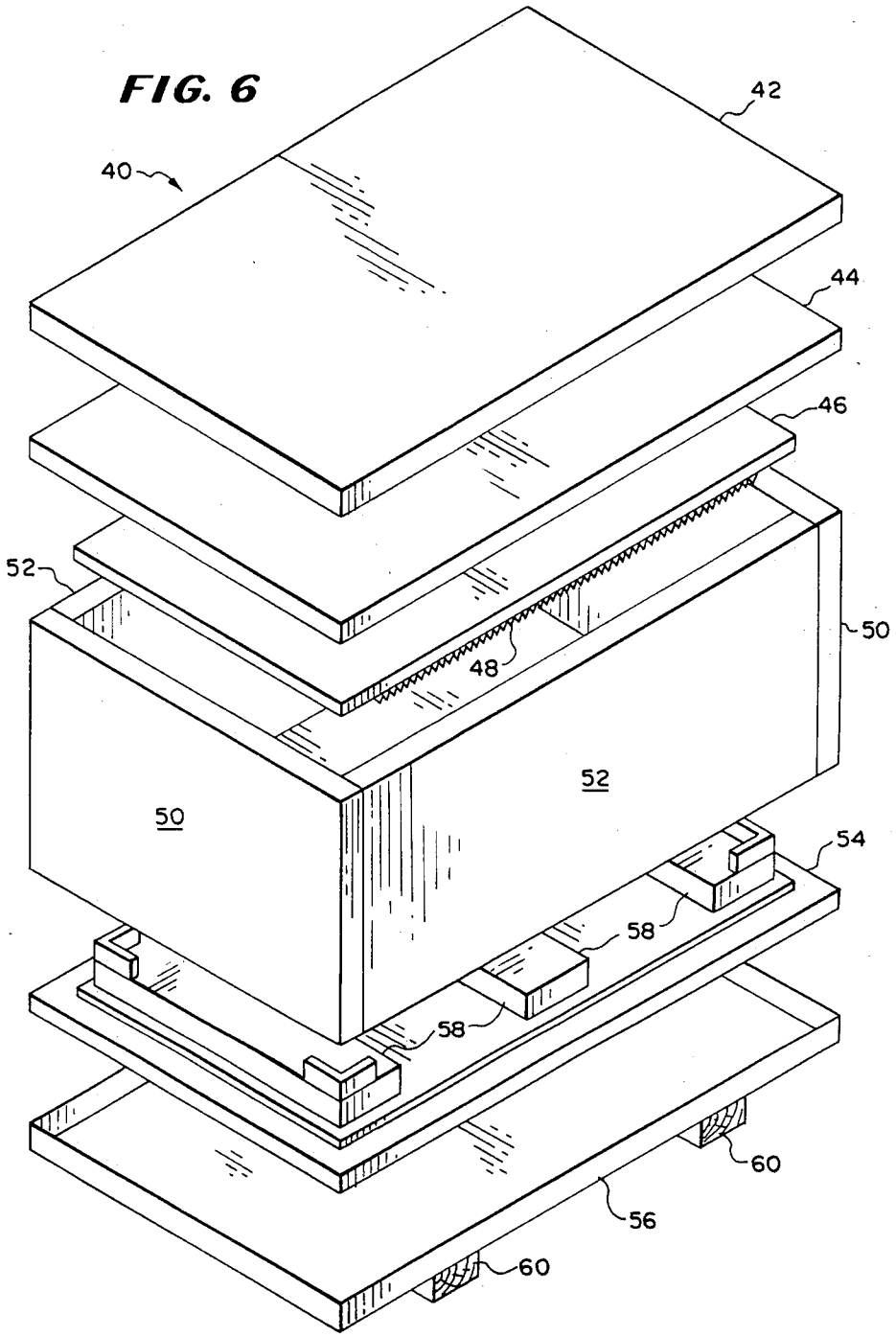
FIG. 6 is an exploded view of a second embodiment of the present invention.
Figure 7:
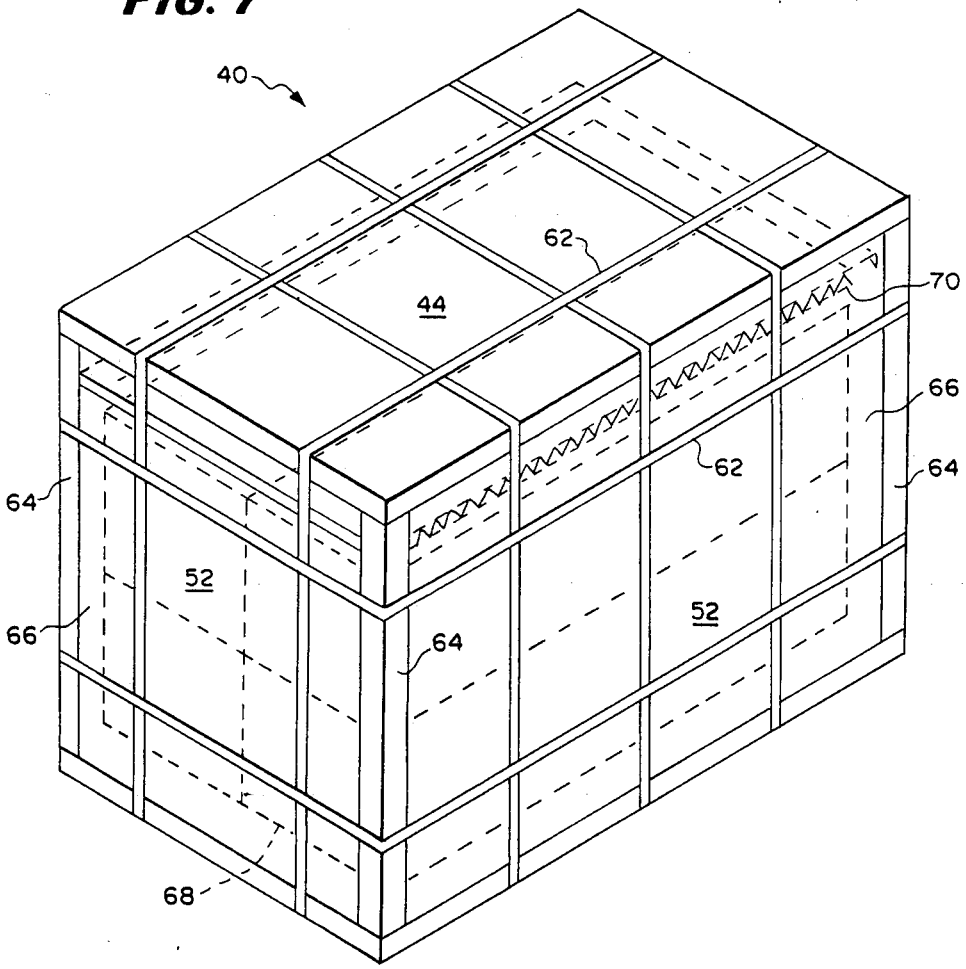
FIG. 7 is an isometric view of the container of FIG. 6.

FIGS. 6 and 7 illustrate a second embodiment of the present invention in which the container 40 is adapted to be disposable. Referring to FIG. 6, the container 40 includes a top cover 42 which is made of aluminum or other metal, a top panel 44 which is made of foam or other insulating material, and a support structure in the form of a tray 46 to hold the passive heat exchange medium, such as dry ice. The tray 46 is made of aluminum or other metal and includes fins 48 on its bottom surface to provide maximum surface area to the convection current. The container 40 also includes two end panels 50 and front and back panels 52 which are disposed on the sides of the container 40 and are made of foam or other insulating material. The container 40 also includes a bottom panel 54 which is made of foam or other insulating material and a bottom tray 56 which is made of aluminum or other metal. There are plastic slats 58 on the top surface of the bottom panel 54 which are made of foam and serve to establish the space between the contents of the container and the bottom panel 54. There are also slats 60 on the bottom exterior surface of the tray 56 which are made of wood, such as 2"×4" lumber, and enable the container 40 to be moved by a forklift.

Referring to FIG. 7, when the container 40 is assembled the components of the container 40 are held together by multiple bands 62, typically metal bands, which pass around the container 40 and apply a slight compressive force all around to achieve a substantially airtight condition. Reinforcing corner guards 64 are mounted at each corner. The exterior surface of the container 40 has a protective panel of aluminum or other metal as the top panel 44 and the bottom tray 56. It has foam panels 52 and 54 around the sides, protected at the corners by aluminum or other metal corner guards 64.

There are spacing devices on the interior surfaces of the container 40 to provide a space 66 of about one inch or slightly more between the contents 68 inside the container 40 and substantially the entire inner surface of the sides and bottom of the container 40, and between the contents 68 of the container 40 and the support structure 70 for the heat exchange medium in a manner similar to the preferred embodiment described in Example 1. Such spacing 66 is provided substantially all around the contents 68 including the bottom, the top and the sides, by blocks and fins similar to those used on Example 1.

DETAILED DESCRIPTION

The present invention may be used for shipment of products by transportation other than air or for use in the storage of products, even where no shipment is contemplated. Other dimensions for the outer shell 6 may be used. For other containers within the scope of the present invention, ordinary ice may be used instead of dry ice to maintain the contents of the container 2 and 40 cold. If the container is intended to maintain the contents warm, the passive heat exchange medium may be blocks of warm or hot material. It has been found that a container of the present invention will maintain frozen products in a frozen condition for up to ninety hours. This is significant because it is more than sufficient to allow frozen products to be shipped on commercial airplanes. Typically, the time periods for shipment by air are in the range of twenty-four hours, forty-eight hours or sixty hours.

It has been discovered that an arrangement which provides space between the contents of the container and substantially the entire inner surface of the sides and bottom of the outer shell and between the contents of the container and the support structure for the heat exchange medium drastically increases the efficiency of the container in maintaining the contents at a desired temperature for an extended period of time. The space allows convection to develop around the contents, including all sides, the top and the bottom of the contents. The convection maximizes the efficiency of the passive heat exchange medium in keeping the contents frozen, or cold, warm, or hot. The convection drastically improves the ability of the container to maintain a uniform temperature throughout the contents. For example, it has been discovered that if the contents are allowed to rest on the bottom inner surface of the container with no space between the bottom inner surface of the container and the contents, there will be a much larger difference in temperature between the temperature of the contents adjacent to the bottom surface of the container and the temperature of the contents adjacent to the top surface of the container. If the container 40 is used for the shipment of frozen products, dry ice at the top of the container will not be able to maintain products adjacent to the bottom of the container in a frozen condition for as long as the dry ice can maintain the products adjacent to the top of the container in a frozen condition.

The container is particularly useful for the shipment of premixed frozen drugs. Many drugs lose their potency within a short period of time, such as a few hours after the drugs have been mixed in a diluent solution for injection intravenously into the veins of a patient. As a result, a therapy has been developed by which manufacturers of I.V. solutions supply premixed drugs in frozen condition to hospitals. The frozen condition inhibits loss of potency of the drug. The frozen drugs are thawed in the hospital just prior to use. There is a need to ship such premixed frozen drugs by air or other expedited transportation. The container of the present invention is especially useful in the shipment of such premixed frozen drugs in commercial airplanes or other common carrier.

Typically the premixed frozen drugs are packaged in plastic bags. The bags are packaged in cardboard corrugated containers. The corrugated containers are packed in a shipping container of the present invention and are shipped by commercial aircraft. It is absolutely essential that the contents of the shipping container, the frozen drugs, remain in a frozen condition for twenty-four hours, or forty-eight hours, or sixty hours, or seventy-two hours, or for up to ninety hours, during shipment by air. It has been found that a container of the present invention will maintain frozen products in a frozen condition for up to ninety hours. This is significant because it is more than sufficient to allow frozen products to be shipped on commercial airplanes. Typically, the time periods for airshipment are in the range of twenty-four hours, forty-eight hours and sixty hours.

We claim:

1. A container for maintaining its contents at a desired temperature for an extended period of time, comprising:

an outer shell which is substantially airtight and which has side walls and inner surfaces;

a passive heat exchange medium;

a support structure for the heat exchange medium; and means for maintaining a space between the contents of the container and substantially the entire inner surface of the sides and bottom of the outer shell of the container and between the contents of the container and the support structure for the heat exchange medium for allowing convection in said space to maintain a substantially uniform temperature throughout the contents of the conter;

said spacer means comprising blocks, each block having a side which faces said side wall of said container and a side which faces said contents, each of said sides of said blocks having a surface area which is less than 70% of the surface area of the adjacent side wall of said container.

2. The container according to claim 1 wherein said support structure for the heat exchange medium comprises an arrangement of fins on the inner side of said support structure adapted to maximize conductivity between the heat exchange medium and the space.

3. The container according to claim 1 wherein said outer shell comprises: an impact resistant outer layer; a rigid, high-strength layer next to said outer layer; an inner layer; and an insulating layer between said rigid, high-strength layer and said inner layer.

4. The container according to claim 1 wherein said passive heat exchange medium is a refrigerant medium and said container is adapted for maintaining the contents of the container in a frozen condition for up to ninety hours.

5. The container according to claim 1 wherein said passive heat exchange medium is dry ice and said container is adapted for shipment in a commercial airplane and for maintaining the contents of the container in a frozen condition for up to ninety (90) hours.

6. The container according to claim 1 wherein said outer shell comprises a series of sections whereby the container can be broken down into a smaller volume after use and whereby some sections of the outer shell may be stored inside of the container when the container is not in use.

7. The container according to claim 1 wherein said outer shell comprises compression locks and sealing means for maintaining a substantially airtight condition.

8. The container according to claim 1 wherein said outer shell comprises: a top cover; a top panel; end panels; front and back panels; a bottom panel; and a bottom tray.

9. The container according to claim 8 wherein the components of the container are held together by multiple bands which pass around the container.

10. A container for maintaining its contents in a frozen condition for an extended period of time comprising:

an outer shell which is substantially airtight and has side walls and inner surfaces;

said outer shell comprising an impact resistant outer layer; a rigid, high-strength layer next to said outer layer; an inner layer; and an insulating layer between said rigid, high-strength layer and said inner layer;

a passive heat exchange medium in the form of dry ice;

a support structure for the heat exchange medium having an arrangement of fins on the inner side of said support structure adapted to maximize conductivity between the dry ice;

spacer means for maintaining space between the contents of the container and substantially the entire inner surface of the sides and bottom of the outer shell of the container and between the contents of the container and the support structure for the dry ice for allowing convection in said air space to maintain a substantially uniform temperature throughout the contents of the container;

said spacer means comprising blocks, each block having a side which faces said side wall of said container and a side which faces said contents, each of said sides of said blocks having a surface area which is less than 70% of the adjacent side wall of said container.

11. A container for maintaining its contents at a desired temperature for an extended period of time, comprising:

an outer shell which is substantially airtight and which has an inner surface;

a passive heat exchange medium;

a support structure for the heat exchange medium;

means for maintaining a space between the contents of the container and substantially the entire inner surface of the sides and bottom of the outer shell of the container and between the contents of the container and the support structure for the heat exchange medium for allowing convection in said space to maintain a substantially uniform temperature throughout the contents of the container;

wherein said outer shell comprises separable components, including: a top cover; a top panel; end panels; front and back panels; a bottom panel; and a bottom tray; and means for separation of said components of the container comprising multiple bands which pass around the container.

* * * * *

UNITED STATES PATENT AND TRADEMARK OFFICE

CERTIFICATE OF CORRECTION

PATENT NO. : 4,576,017
DATED : March 18, 1986
INVENTOR(S) : Cathy M. Combs, Joseph K. Duffy, Mark Thoene It is certified that error appears in the above-identified patent and that said Letters Patent are hereby corrected as shown below:

In Claim 1, Column 6, Line 10:

Change "conter" to --container--.

Signed and Sealed this

*Twenty-ninth* Day of *July 1986*

[SEAL]

*Attest:*

DONALD J. QUIGG

*Attesting Officer*

*Commissioner of Patents and Trademarks*